US008172625B2

(12) United States Patent
Kashiwada et al.

(10) Patent No.: US 8,172,625 B2
(45) Date of Patent: May 8, 2012

(54) SPHERICAL TERMINAL WITH GUIDE GROOVE

(75) Inventors: Tomokazu Kashiwada, Yokkaichi (JP); Sho Miyazaki, Yokkaichi (JP); Shiro Nishida, Yokkaichi (JP); Masaharu Suetani, Yokkaichi (JP); Kiyoshi Hasegawa, Yokkaichi (JP)

(73) Assignees: Autonetworks Technologies, Ltd, Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 118 days.

(21) Appl. No.: 12/733,534

(22) PCT Filed: Jun. 24, 2008

(86) PCT No.: PCT/JP2008/061439

§ 371 (c)(1),
(2), (4) Date: Mar. 5, 2010

(87) PCT Pub. No.: WO2009/034761

PCT Pub. Date: Mar. 19, 2009

(65) Prior Publication Data

US 2010/0173538 A1 Jul. 8, 2010

(30) Foreign Application Priority Data

Sep. 12, 2007 (JP) ..... 2007-236838
May 13, 2008 (JP) ..... 2008-126265

(51) Int. Cl.
*H01R 4/48* (2006.01)

(52) U.S. Cl. ..... 439/848; 439/8

(58) Field of Classification Search ..... 439/848, 439/857, 8
See application file for complete search history.

(56) References Cited

U.S. PATENT DOCUMENTS 513,949 A * 1/1894 Munson ..... 439/272
826,287 A 7/1906 Svenson
937,052 A * 10/1909 Cuno ..... 439/429
(Continued)

FOREIGN PATENT DOCUMENTS

DE 2 123 568 12/1971
(Continued)

OTHER PUBLICATIONS

Written Opinion of the International Searching Authority issued in International Application No. PCT/JP2008/061439 on Sep. 9, 2008 (with translation).

(Continued)

*Primary Examiner* — Neil Abrams
(74) *Attorney, Agent, or Firm* — Oliff & Berridge, PLC

(57) ABSTRACT

In a pair of mutually connectable terminals, one terminal is provided with a joint having a spherical surface formed on the outer circumferential surface, and the other terminal is provided with a hole into which the joint can be fitted. At least one of the joint and the hole is formed in a plate member which can be displaced elastically in the fitting direction of the joint and the hole. When the pair of terminals are connected, the joint touches the circumferential edge of the hole to displace the plate member elastically. When the joint is fitted in the hole, the plate member is reset elastically and holds the spherical surface of the joint under such a state as the spherical surface is pressed against the edge of the hole.

16 Claims, 13 Drawing Sheets

U.S. PATENT DOCUMENTS

| | | | | | |
|---|---|---|---|---|---|
| 1,074,459 | A | * | 9/1913 | Pogue | 439/568 |
| 1,236,404 | A | * | 8/1917 | Clerger | 439/342 |
| 1,520,485 | A | * | 12/1924 | Singleton | 361/220 |
| 1,531,917 | A | * | 3/1925 | French | 439/247 |
| 1,835,000 | A | * | 12/1931 | Berthold | 439/848 |
| 1,911,395 | A | * | 5/1933 | Rowley | 439/263 |
| 1,975,999 | A | * | 10/1934 | Young | 439/838 |
| 2,022,669 | A | * | 12/1935 | Keefe | 439/739 |
| 2,221,280 | A | * | 11/1940 | Woodside | 200/51.07 |
| 2,428,214 | A | * | 9/1947 | Gorey | 439/593 |
| 2,612,139 | A | * | 9/1952 | Collins | 119/865 |
| 2,853,691 | A | * | 9/1958 | McCord | 439/218 |
| 2,911,614 | A | * | 11/1959 | Davis | 439/668 |
| 2,958,843 | A | * | 11/1960 | Long | 439/593 |
| 2,972,728 | A | * | 2/1961 | Cole | 439/246 |
| 2,999,998 | A | * | 9/1961 | Cole | 439/252 |
| 3,171,183 | A | * | 3/1965 | Johnston | 24/635 |
| 3,196,377 | A | * | 7/1965 | Minich | 439/60 |
| 3,196,378 | A | * | 7/1965 | Beckwith | 439/701 |
| 3,223,963 | A | * | 12/1965 | Rarey et al. | 439/846 |
| 3,329,851 | A | * | 7/1967 | Braeutigam et al. | 313/512 |
| 3,675,187 | A | * | 7/1972 | Christman | 439/596 |
| 3,676,838 | A | * | 7/1972 | Hartz et al. | 439/749 |
| 3,833,878 | A | * | 9/1974 | Kinast | 439/718 |
| 4,842,536 | A | * | 6/1989 | Meyrat et al. | 439/246 |
| 4,991,290 | A | * | 2/1991 | MacKay | 29/884 |
| 5,332,394 | A | * | 7/1994 | Frost | 439/125 |
| 5,403,988 | A | | 4/1995 | Kawada et al. | |
| 5,634,829 | A | * | 6/1997 | Kerul | 439/851 |
| 5,663,012 | A | * | 9/1997 | Shannon et al. | 429/121 |
| 5,711,676 | A | * | 1/1998 | Michael, III | 439/63 |
| 5,984,694 | A | * | 11/1999 | Sinclair | 439/70 |
| 6,045,416 | A | | 4/2000 | Sinclair | |
| 6,319,015 | B1 | * | 11/2001 | Faunce | 439/37 |
| 6,893,300 | B2 | * | 5/2005 | Zhou et al. | 439/862 |
| 6,976,875 | B2 | | 12/2005 | Nishide | |
| 7,059,916 | B2 | | 6/2006 | Nishide | |
| 7,108,551 | B2 | | 9/2006 | Nishide | |
| 7,946,890 | B1 | * | 5/2011 | Bondo et al. | 439/638 |
| 2005/0095876 | A1 | | 5/2005 | Nishide | |
| 2005/0095910 | A1 | | 5/2005 | Nishide | |
| 2005/0095921 | A1 | | 5/2005 | Nishide | |
| 2006/0025017 | A1 | * | 2/2006 | Sikora et al. | 439/620 |

FOREIGN PATENT DOCUMENTS

| | | |
|---|---|---|
| GB | 469448 | 7/1937 |
| JP | A-46-7228 | 12/1971 |
| JP | U-52-52093 | 4/1977 |
| JP | U-52-122392 | 9/1977 |
| JP | A-04-223073 | 8/1992 |
| JP | A-05-082222 | 4/1993 |
| JP | U-05-027991 | 4/1993 |
| JP | A-06-344290 | 12/1994 |
| JP | A-08-185932 | 7/1996 |
| JP | A-10-106707 | 4/1998 |
| JP | A-2005-110349 | 4/2005 |
| JP | A-2005-141927 | 6/2005 |

OTHER PUBLICATIONS

International Search Report issued in International Application No. PCT/JP2008/061439 on Sep. 9, 2008.

German Office Action issued Dec. 12, 2011 for German Application No. 11 2008 002 371.9 (with translation).

* cited by examiner

SPHERICAL TERMINAL WITH GUIDE GROOVE

TECHNICAL FIELD

The present invention relates to a pair of mutually connectable terminals.

BACKGROUND ART

Conventionally, as a pair of mutually connectable terminals, the female and male terminals disclosed in the Patent literature 1 have been well-known. The female terminal comprises a box-shaped main body in which an elastic contact piece is provided, and, in addition, provided on the surface in the main body which is opposed to the elastic contact piece is a receiving part protruding internally (to the side of the elastic contact piece). When a tab in the male terminal is inserted into the main body of the female terminal, the tab is elastically held between the elastic contact piece and the receiving part, so that both the male and female terminals are held in a conductive state.

[Patent Literature 1]: Japanese Unexamined Patent Publication No. 2005-141927

Recently, as the development of hybrid vehicles progresses, more wires having greater diameters than the conventional wires are used. The flexural rigidity of wires becomes greater as the diameter of the wires becomes greater, and therefore, a greater restoring force works on the terminals when the wires are bent and arranged due to a narrower space, as compared with the conventional case of bending thinner wires.

Additionally, with respect to terminals having the configuration as mentioned above, for example, when a thick wire is twisted and arranged and a greater force in the rotational direction as compared with conventional one is worked on the terminals, the tab is tilted relatively to the elastic contact piece and the receiving part, causing a deviation in the contacting part, with a greater electrical resistance generated between both terminals. Such state might therefore affect the connection state adversely, and a countermeasure has been required.

This invention has been completed based on the above circumstances, and its purpose is to provide a terminal capable of maintaining a good connection state between terminals, even when a force from a wire is applied.

SUMMARY

The present invention relates to a pair of mutually connectable terminals wherein one terminal is provided with a joint having a spherical surface formed on the outer circumferential surface, and the other terminal is provided with a hole into which the joint can be fitted. At least one of the joint and the hole is formed in a plate member capable of elastic deformation in a fitting direction of the joint and the hole. When the pair of terminals is connected, the joint touches the circumferential edge of the hole to displace the plate member elastically. When the joint is fitted in the hole, the plate member is restored elastically and holds the spherical surface of the joint under such a state as the spherical surface is pressed against the edge of the hole. With such configuration, a good connection state of the terminals can be maintained, even when both the terminals are relatively displaced due to a force applied from a wire.

According to the present invention, there can be provided a terminal capable of maintaining a good connection state between terminals even when a force from a wire is applied.

DESCRIPTION OF SYMBOLS

10, 70 . . . male terminal (one terminal)
12, 71 . . . joint
20, 50, 60, 80 . . . female terminal (the other terminal)
22 . . . opposing wall (plate member)
24A . . . guiding surface
25, 51, 61 . . . hole
27, 81 . . . guide groove
72 . . . male side opposing wall (plate member)

BEST MODE FOR CARRYING OUT THE INVENTION

<Embodiment 1>

Figure 1:
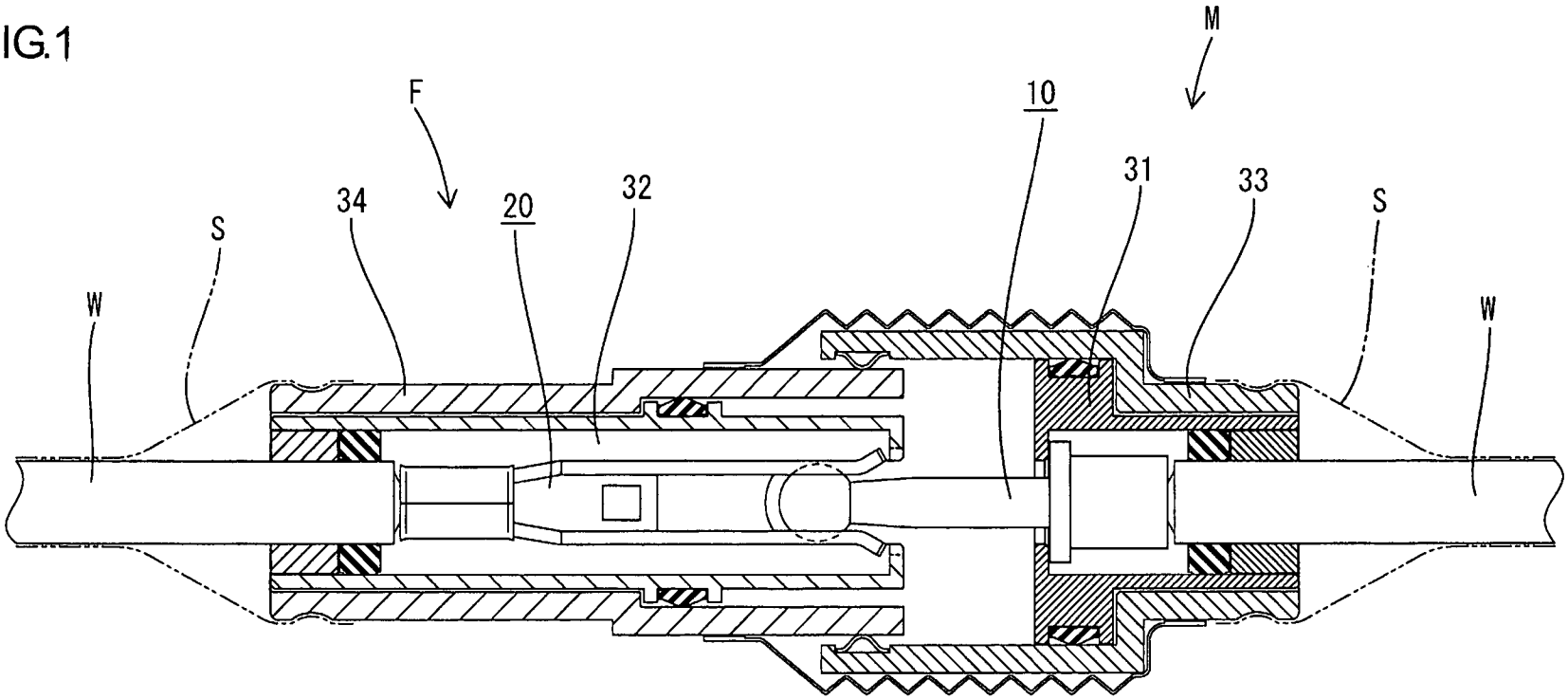
FIG. 1 is a cross-sectional view showing a regular fitting state between a male connector and a female connector in Embodiment 1.
Figure 8:
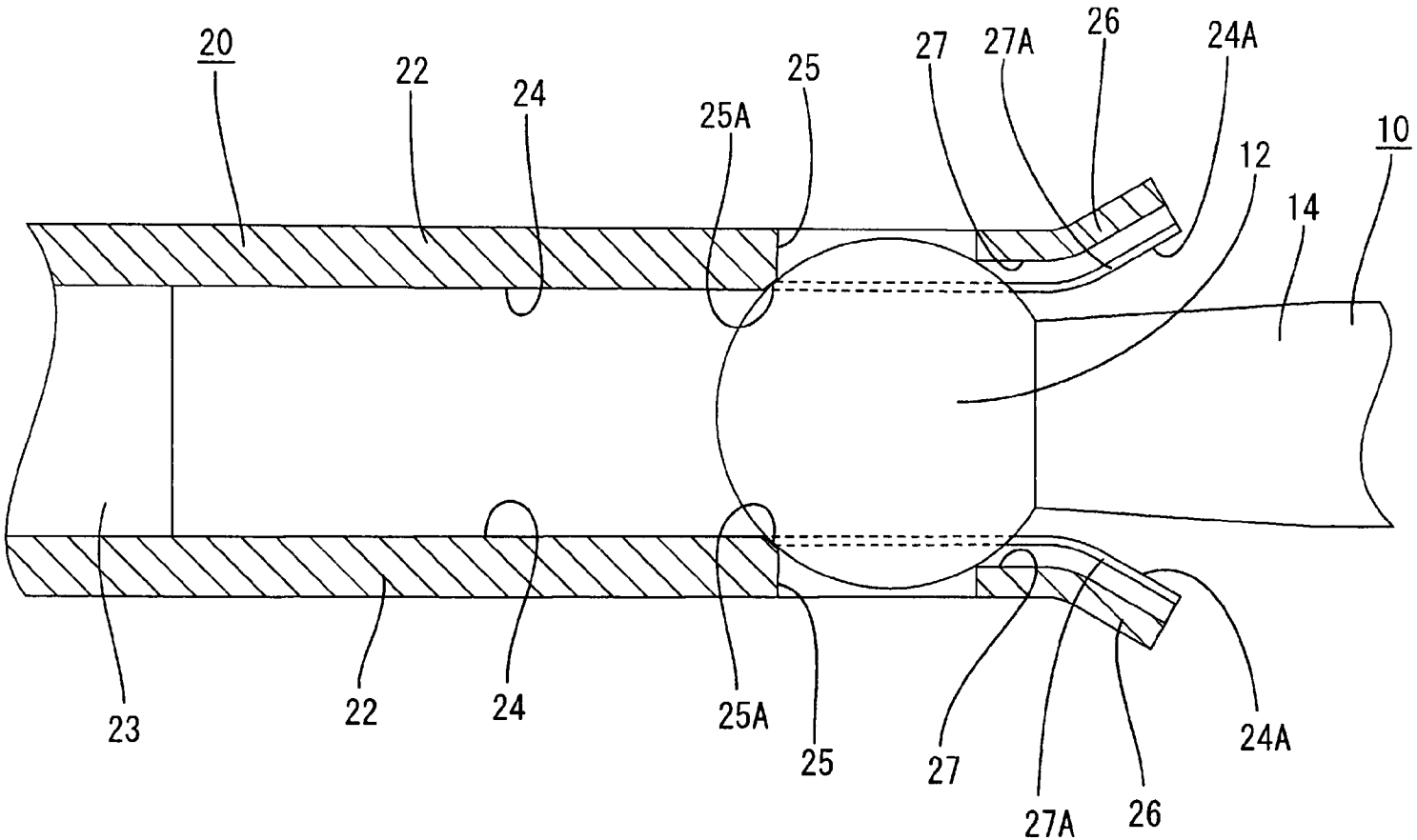
FIG. 8 is a partially-enlarged cross-sectional view showing a state where a joint is fitted in a hole.

In what follows, in reference to FIGS. 1 and 8, Embodiment 1 of the present invention is described. Terminals in the present embodiment are a pair of a male terminal 10 (corresponding to one terminal in the invention of the present application) and a female terminal 20 (corresponding to the other terminal in the same) which are mutually connectable, and respectively fixed to a terminal part of a wire W for use. Each wire W is used in a motor circuit and has a diameter, that is greater than that of the wire W used in a signal circuit, as well as a high flexural rigidity. Each wire W is shielded and enwrapped respectively by a shielding material S made of braided wires.

The male terminal 10 and the female terminal 20 are housed for use respectively in a male housing 31 and a female housing 32 made of a synthetic resin. Both housings 31 and 32 are covered respectively with a metallic male side shell 33 and a metallic female side shell 34, and terminal parts of the shielding materials S are fixed respectively to both the shells 33 and 34 in an electrically conductive state.

When a male connector M comprising the male terminal 10 housed in the male housing 31 and a female connector F comprising the female terminal 20 housed in the female housing 32 reach in a regular fitting state, both the terminals 10 and 20 are mutually connected, while at the same time that the male side shell 33 and the female side shell 34 are fitted in an electrically conductive state.

Figure 2:
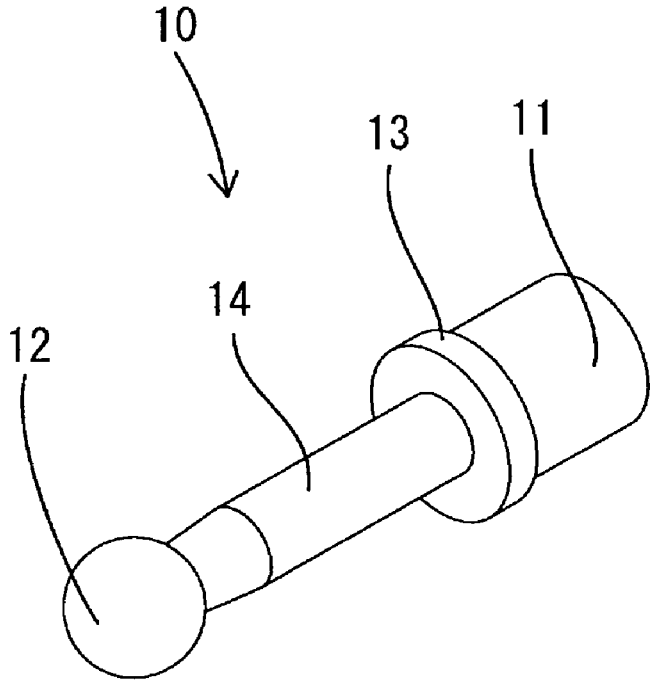
FIG. 2 is an external perspective view of a male terminal.

Next, the male terminal 10 and the female terminal 20 are explained, while regarding the front side in a connecting direction of both the terminals 10 and 20 as the front. The copper alloy-made male terminal 10 is long in the front and rear direction on the whole as shown in FIG. 2, in which the rear end part is a wire fixing member 11 to be fixed to the wire W in an electrically conductive state, while the front end part is a joint 12 to be connected with the female terminal 20 in an electrically conductive state. The wire fixing member 11 forms a nearly cylindrical shape opening to the rear side, and fixed to the inside thereof is the core wire in the wire W.

Formed at the front end part of the wire fixing member 11 is a collar 13 projecting to the outside around the entire circumference. When the male terminal 10 is housed in the male housing 31, the front wall of the collar 13 abuts on the male housing 31, thereby positioning the male terminal 10 in the front and rear direction.

The joint 12 and the wire fixing member 11 are continued by a connecting member 14. The connecting member 14 is in a nearly columnar shape and long in the front and rear direction in which the front end part (the end part in the side of the joint 12) is in a tapered shape, with its diameter gradually become smaller as extending toward the front (the side of the joint 12).

The joint 12 is in a spherical shape on the whole, with its position of the center of gravity arranged on the extending line of the axis line of the connecting member 14. The diameter of the joint 12 is larger than the one of the connecting member 14, while being smaller than the external diameter of the wire fixing member 11.

Figure 3:
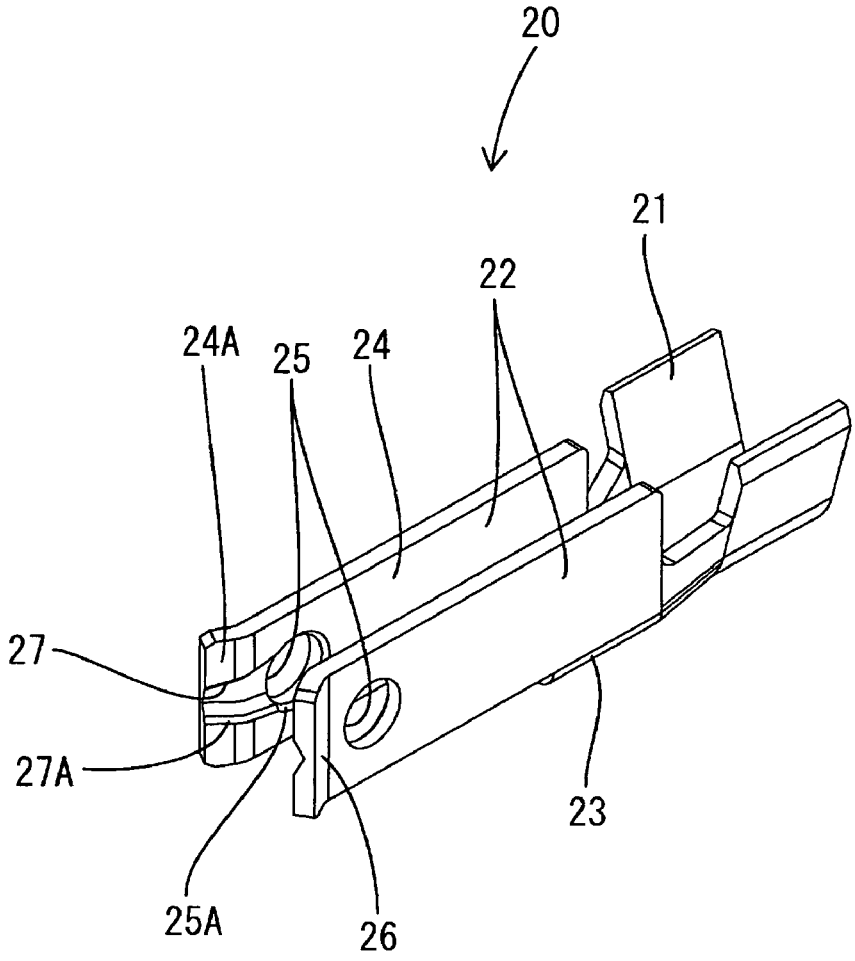
FIG. 3 is an external perspective view of a female terminal.

The female terminal 20 is formed by bending a metallic thin plate having a high conductivity (for example, a copper alloy-made thin plate), and has a shape thin and long in the front and rear direction on the whole as shown in FIG. 3. The rear end part of the female terminal 20 is a barrel part 21 to be caulked with the wire W in an electrically conductive manner. In a state before being caulked with the wire W, the barrel part 21 has a nearly U shape, opening upward (the upward in FIG. 5) when viewed in the front and rear direction. This barrel part 21 is caulked in a manner so as to surround the core wire of the wire W.

Figure 4:
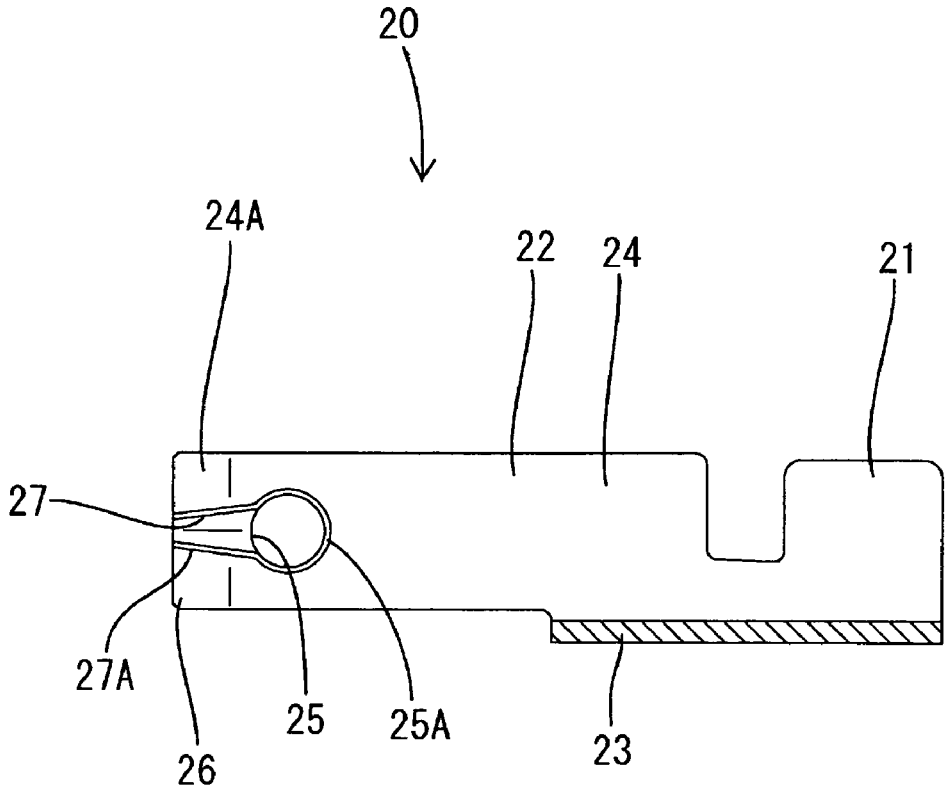
FIG. 4 is a side cross-sectional view of a female terminal.

Provided in the front of the barrel part 21 is a pair of opposing walls 22 (corresponding to a plate member in the present invention). The opposing wall 22 is in a plate shape that is nearly rectangular, and thin and long in the front and rear direction. The pair of opposing walls 22 is connected at the rear end with a bottom plate member 23 extending toward the front from the bottom section of the barrel part 21 as shown in FIG. 4, and is in a cantilevered shape on the whole having its front end as a free end. They are capable of elastic deformation mutually in the opposing direction (the expanding direction).

Figure 5:
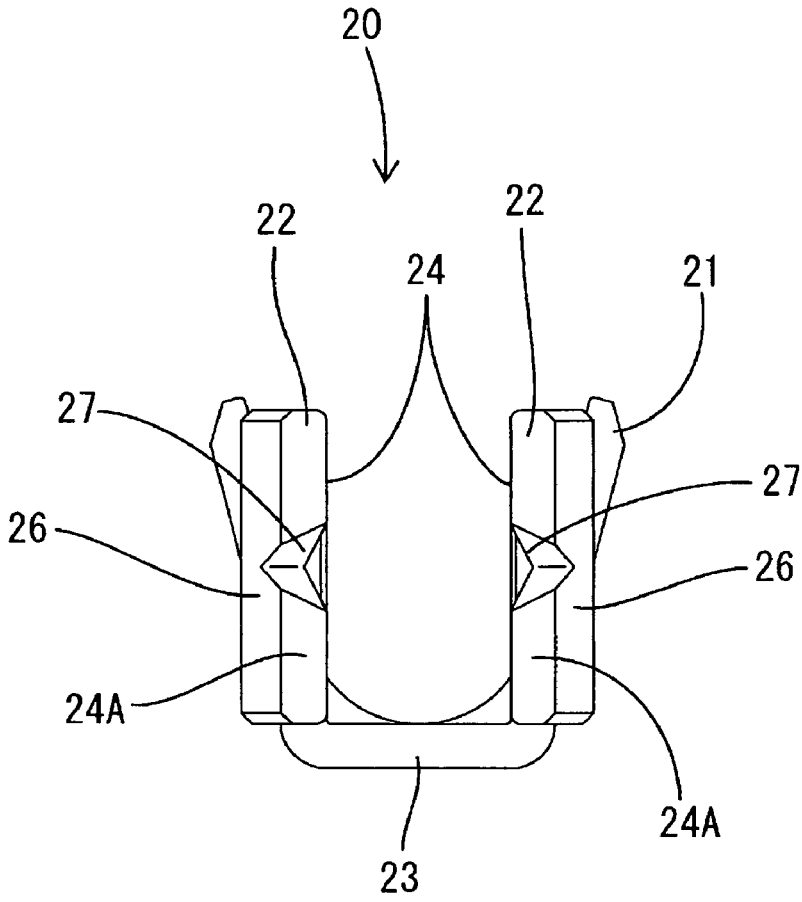
FIG. 5 is an elevation view of a female terminal.

The pair of opposing walls 22 is, as shown in FIG. 5, in a shape bent at the both side edges of the bottom plate member 23 in the nearly perpendicular direction to the plate face of the bottom plate member 23, with both opposing faces 24 arranged nearly in parallel each other. The space between the pair of opposing walls 22 (the space between the opposing faces 24) is, in natural state with no elastic deformation of the opposing walls 22, smaller than the diameter of the joint 12, more particularly, than the maximum diameter of the diameter of the cross section of the male terminal 10 in a direction orthogonal to the insertion direction (the axis line direction of the connecting member 14).

Each opposing wall 22 is provided with a circular hole 25 into which the joint 12 can be fitted. The holes 25 are arranged in the mutually opposing positions in the front end of the opposing walls 22 (the end part in the opposite side to the barrel part 21).

The hole 25 penetrates the opposing wall 22 in a wall thickness direction (the opposing direction of the opposing walls 22). Both the holes 25 are in the same shape and arranged coaxially. The diameter of the hole 25 is smaller than the diameter of the joint 12, more particularly, than the maximum diameter of the diameter of the cross section of the male terminal 10 in a direction parallel to the insertion direction (the axis line direction of the connecting member 14).

The hole edge in the side of the opposing face 24 among both the hole edges of each hole 25 is chamfered around the entire circumference. This forms a contact tapered surface 25A forming a slope with its diameter gradually decreases as extending toward the rear side of the hole 25 (the side opposite to the opposing face 24).

The front end edges of the pair of opposing walls 22 (the end edge in the side into which the joint 12 is inserted) are guiding members 26 in a shape bent in a direction separating away each other. The guiding member 26 is constituted by bending the nearly half front portion of the portion from the front end edge to the hole 25 in the opposing wall 22. The inner face of the guiding member 26 (the portion of the guiding member 26 among the opposing face 24) is a guiding surface 24A forming a slope toward the front in a direction separating away from the opposite opposing wall 22.

Provided in the portion from the front end edge (the end edge in the side into which the joint 12 is inserted) to the hole 25 on the opposing wall 22 is a guide groove 27 for guiding the joint 12. The guide groove 27 is formed in nearly the center in the short side direction of the opposing wall 22, extending in the longitudinal direction. The guide groove 27 is formed by denting the opposing face 24 to the outside (to the side separating away from the opposite opposing face 24), and its depth is almost the half of the plate thickness of the opposing wall 22.

Both side edges of the guide groove 27 (the edges along the opposing face 24) are, as shown in FIG. 4, formed in a slope shape, with the space there between separated away from each other as they extend from the front end to the rear side (the side of the hole 25), and in other words, the guide groove 27 is formed to gradually increase its width from the front end to the rear side (the side of the hole 25).

In addition, both the side edges of the guide groove 27 are chamfered from the front to the rear side, and formed in both the side edges are guide tapered surfaces 27A, with the groove width spread toward the inside (the side of the opposing face 24). The guide tapered surface 27A is in a shape continuously connected with the contact tapered surface 25A.

A liquid metal (such as galinstan and mercury) not shown is applied onto the outer circumferential surface (spherical surface) of the joint 12 and the contact tapered surface 25A in the hole 25. Galinstan is an eutectic alloy of gallium, indium, and tin. The liquid metal is applied by such as being attached by directly immersing these members in the liquid or by a cotton swab. Additionally, the liquid metal may be applied by any method.

Next, the connecting motion of the terminals 10 and 20 constituted as mentioned above is described. The male connector M and the female connector F are faced each other in a fitting direction and brought closer to each other. Then, even when the positions of both the terminals 10 and 20 are deviated relatively, the joint 12 in the male terminal 10 is smoothly guided by the guiding surface 24A without abutting the front end edge of the opposing wall 22. Here, the joint 12 is fitted in the guide groove 27 in the guiding member 26 and positioned in the short side direction of the opposing wall 22.

Figure 6:
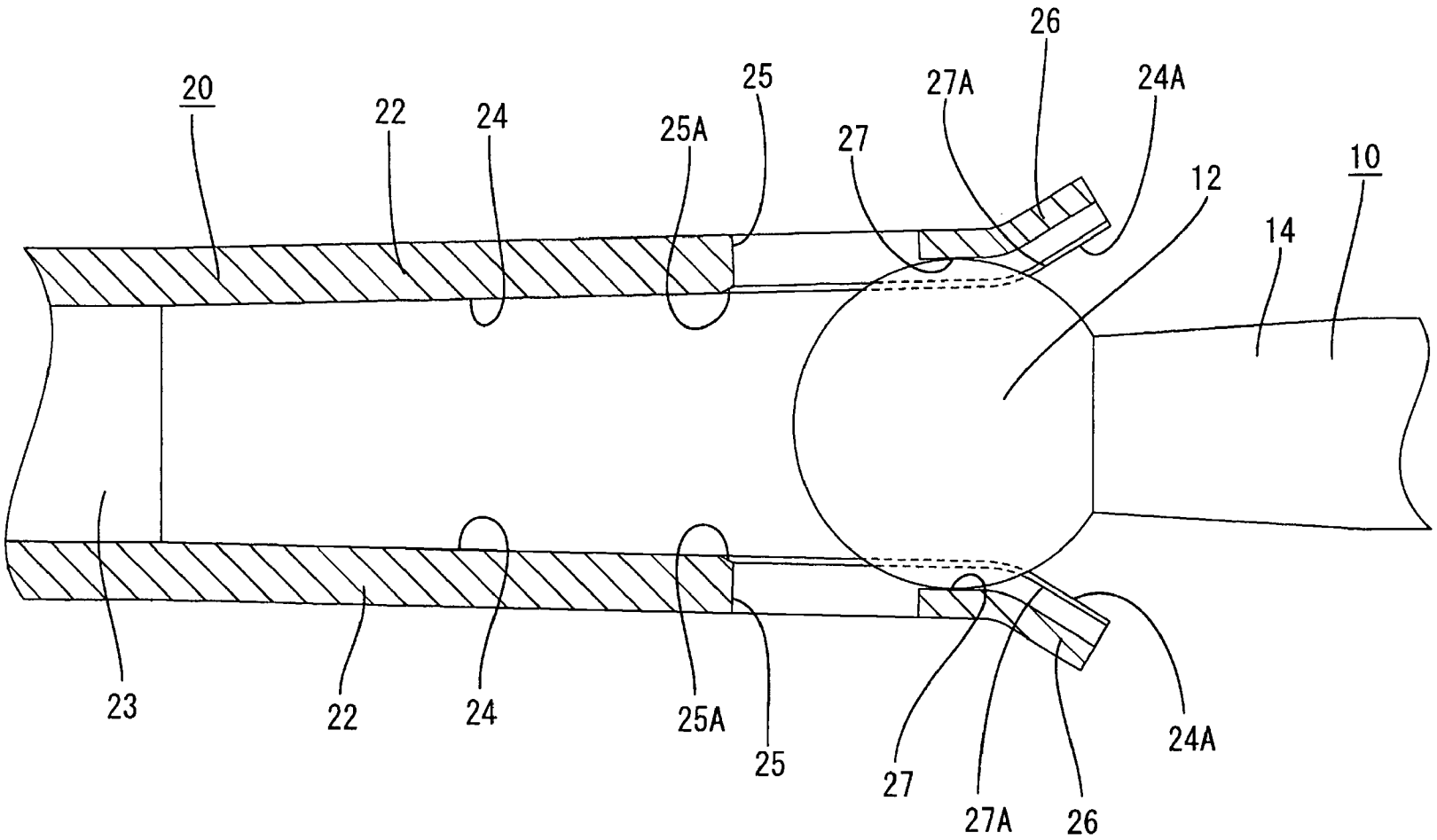
FIG. 6 is a partially-enlarged cross-sectional view showing a state where a joint is being inserted into a space between opposing walls.
Figure 7:
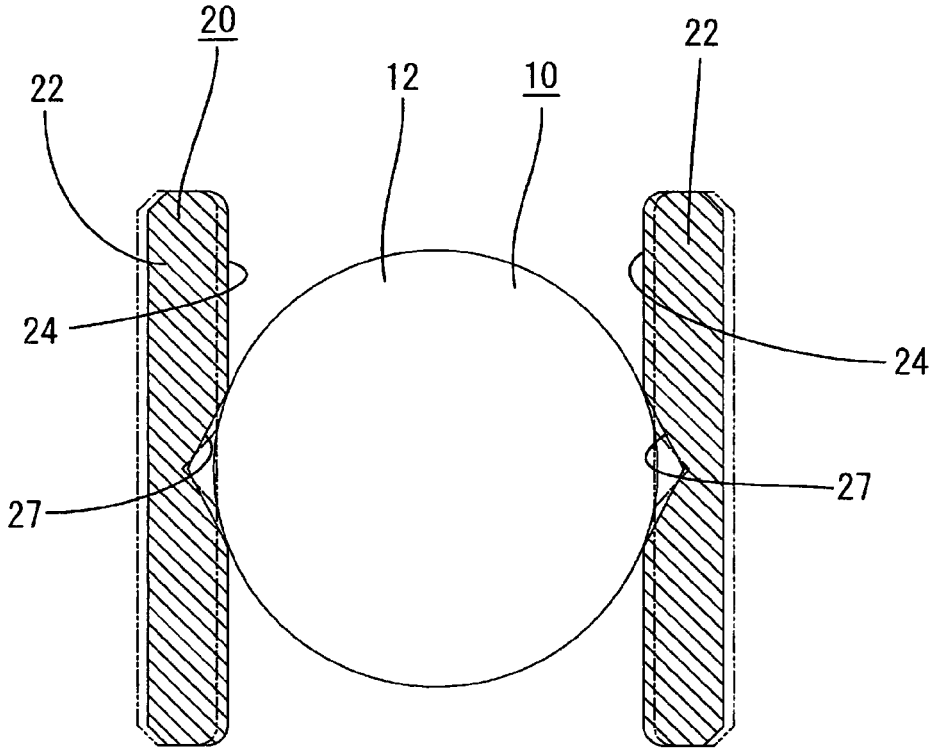
FIG. 7 is a conceptual view showing a state where a joint is being inserted into a space between opposing walls.

Bringing both the connectors M and F further closer to each other causes the joint 12 to be inserted deeper than the guiding surface 24A, and then, as shown in FIG. 6, the joint 12 contacts with the portion in front of the hole 25 in the opposing wall 22 (the circumferential edge of the hole 25) and presses the opposing walls 22 toward the outside, and thereby elastically deforming both the opposing walls 22 in an expanding direction. Then, the joint 12 is guided by the guide groove 27 with its spherical surface in contact with the guide tapered surface 27A, then goes to the back toward the hole 25 without deviating to the side. Here, since the groove width of the guide groove 27 is formed to gradually increase as it goes to the back, the joint 12 is fitted deeper in the guide groove 27 as it goes to the back, and this allows the pair of opposing walls 22 to be elastically restored in a direction approaching each other. In other words, the amount of the elastic deformation of the pair of opposing walls 22 is decreased as the joint 12 goes to the back, causing the force works on the joint 12 (the force of the pair of opposing walls 22 holding the joint 12) to be decreased by the amount, and the insertion resistance of the joint 12 is thereby reduced as it goes to the back. As a result, a moment when the joint 12 is inserted from the guiding surface 24A to the back is the peak of the insertion force applied to the joint 12, and after that, the insertion force is decreased. Accordingly, on being inserted from the guiding surface 24A to the back, the joint 12 is pushed at once to the hole 25, so that both the terminals 10 and 20 achieve a regular connection state. Therefore, for example, a worker's misunderstanding that the connection of the terminals were completed due to the increase in the insertion resistance of the joint at a position close to the hole can be prevented, and it is thus prevented for both the terminals 10 and 20 to remain in a half-insertion state. In addition, FIG. 7 shows a state where the opposing walls 22 shown with dashed-two dotted lines are slightly opened when the joint 12 is positioned in the front side as compared with being in the back side.

The joint 12, that has been inserted at once to the hole 25, then sinks and fits in the hole 25 as shown in FIG. 8, while the pair of opposing walls 22 elastically restores in an approaching direction each other. In this moment, the joint 12 comes in a fitted-state in the hole 25, with its spherical surface not protruding out of the hole 25 to the outside (the side opposite to the opposing face 24). Also, the spherical surface of the joint 12 is in a pressed-state against the contact tapered surface 25A around the entire circumference, so that both the terminals 10 and 20 are in a regular and electrically conductive connection state. Additionally, the male connector M and the female connector F in this moment reach a regular fitting state.

When using both the connectors M and F, and, for example, if the wire W is twisted and arranged, causing a large force in the rotational direction (a force in the rotational direction relative to the axis line of the male terminal 10) to work on the female terminal 20 or the male terminal 10, the joint 12 rotates relatively in a space between the pair of opposing walls 22. Here, even when the joint 12 rotates, its spherical surface is held as being in contact with the contact tapered surface 25A round the entire circumference, and it is impossible for the spherical surface and the contact tapered surface 25A to be apart partially.

In addition, also when the joint 12 rotates in the direction centering the penetrating direction of the hole 25 relative to the pair of opposing walls 22, the spherical surface of the joint 12 is constantly kept as being in contact with the contact tapered surface 25A around its entire circumference. Therefore, even when the terminals 10 and 20 receive not only a force generated due to the twisting of the wire W but also a force in any direction generated from such as vibrations or bend of the wire W up and down and right and left, it is impossible for the spherical surface of the joint 12 and the contact tapered surface 25A to be apart partially.

As mentioned, even with a force from the wire W in any directions, no deviation in the contacting part between both the terminals 10 and 20 (the contacting part between the spherical surface of the joint 12 and the contact tapered surface 25A) occurs. Thus, an increase in the electrical resistance between both the terminals 10 and 20 can be prevented, thereby avoiding an adverse effect on the connection state. Additionally, the spherical shape of the joint 12 can deal with relative displacement of rotating 360 degrees relative to the axis line of the male terminal 10.

In addition, the hole edge of the hole 25 is chamfered so as to form the contact tapered surface 25A, that is in a surface-contact with the spherical surface of the joint 12. This allows the contact pressure generated in the contacting part to be dispersed, preventing friction as compared with, for example, a case where the hole edge of the hole is in line contact with the spherical surface of the joint, and thereby achieving a durability for a long time use. Additionally, the guide tapered surfaces 27A on both the side edges of the guide groove 27 are realizing a surface contact between the joint 12 and the guide groove 27 as mentioned above, and friction therefore hardly occurs even when both the terminals 10 and 20 are repetitively connected and disconnected.

And also, a liquid metal is applied onto the spherical surface of the joint 12 and the contact tapered surface 25A. The liquid metal has a conductivity higher than those of such as plated tin and plated silver, and applying such liquid metal to the contacting part between both the terminals 10 and 20 reduces the electrical resistance in the contacting part. Additionally, the liquid metal is hard to be peeled out or scraped off, differently from plating, even when the joint 12 and the contact tapered surface 25A is in friction, and can prevent unevenness from occurring in the connection state between both the terminals 10 and 20.

As mentioned above, according to the present embodiment, the pair of opposing walls 22 elastically deform in an expanding direction when the joint 12 is inserted there between, and then elastically restore when the joint 12 is fitted into the hole 25 so as to hold the joint 12 under such a state as its spherical surface is pressed against the contact tapered surface 25A in the hole 25. Therefore, no deviation generates in the contacting part even when both the terminals 10 and 20 are relatively deformed, and thereby maintaining a good connection state between the terminals 10 and 20. And also, the guiding surface 24A for guiding the joint 12 is formed in the end edge in the insertion side of the joint 12 in the opposing wall 22, so that the joint 12 is smoothly put in a space between the opposing walls 22, allowing the terminals 10 and 20 to be easily inserted. And also, the hole 25 is formed in the opposing wall 22, in which the guide groove 27 for guiding the joint 12 is formed from the end edge in the front side in a direction connecting with the male terminal 10 to the hole 25. This allows the joint 12 to reach into the hole 25 without deviating to the side, and thereby allowing the terminals 10 and 20 to be easily inserted. In addition, a liquid metal is applied onto the outer circumferential surface (spherical surface) of the joint 12 and the contact tape-red surface 25A in the hole 25. This allows the contact resistance in the contacting part between the joint 12 and the hole 25 to be decreased.

<Embodiment 2>

Figure 9:
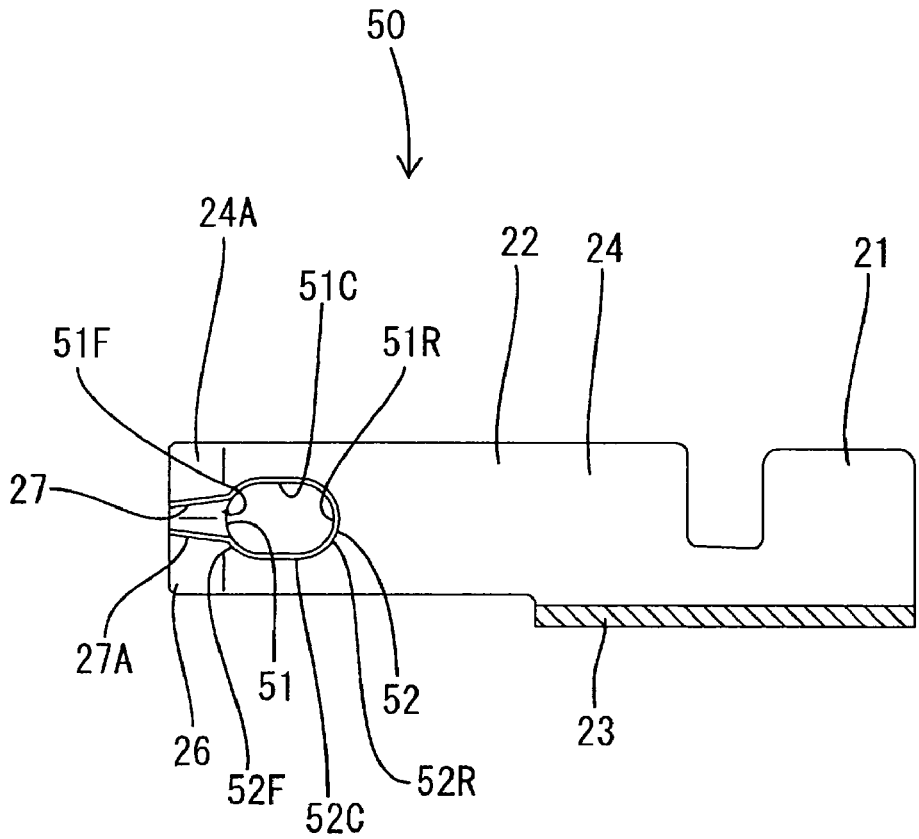
FIG. 9 is a side cross-sectional view of a female terminal according to Embodiment 2.

Next, in reference to FIG. 9, a terminal according to Embodiment 2 of the present invention is described. What is different from Embodiment 1 is that a terminal in the present embodiment is provided with a hole 51 formed in the opposing wall 22 in a female terminal 50, the hole 51 having an oval shape which is long in the front and rear direction (the insertion direction of the joint 12 into the pair of opposing walls 22). Additionally, the constituent elements same as those in Embodiment 1 are allotted with the same numerals, so as to omit repetitive descriptions thereof.

Terminals in the present embodiment are composed of a pair of the male terminal 10 and the female terminal 20, which are mutually connectable as in Embodiment 1, while the font end part of the male terminal 10 is the joint 12 in a spherical shape. In addition, a pair of opposing walls 22 which is capable of holding the joint 12 is provided in the female terminal 50, while the holes 41 capable of fitting with the joint 12 are formed in the respective opposing walls 22.

The holes 51 are, as in Embodiment 1, arranged in the opposing positions in the opposing walls 22 and penetrate the opposing walls 22 in the wall thickness direction (the opposing direction of the opposing walls 22). The hole 51 is in an oval shape which is long in the front and rear direction, with the central part 51C having a constant length in its width in vertical direction (the width in the short side direction of the hole 51), while the front end 51F and the rear end 51R having a semi-circular shape respectively. The upper edge and the lower edge of the hole 51 (the upper edge and the lower edge of the central part 51C) are in nearly parallel with the upper edge and the lower edge of each of the opposing wall 22, in other words, the hole 51 is formed in a direction with its longitudinal direction in parallel with the longitudinal direction of the opposing wall 22. Additionally, the central position in the vertical direction of the hole 51 nearly coincides with the central position in the vertical direction of each opposing wall 22.

The width in the short side direction of the hole 51 is shorter than the diameter of the joint 12, in particular, the maximum diameter in the diameter of the cross section of the joint 12 in parallel with the insertion direction of the male terminal 10 (the axis line direction of the connecting member 14).

And also, the hole edge in the side of the opposing face 24 in each hole 51 is, as in Embodiment 1, chamfered around the entire circumference, and forms a contact tapered surface 52, with the opening dimension of the hole 51 decreased as it goes to the back side of the hole 51 (the side opposite to the opposing face 24 side).

Connecting the terminals 10 and 50 according to Embodiment 2 (in short, fitting both the connectors M and F) causes the joint 12 to sink and fit in the hole 51 as in Embodiment 1, and the pair of opposing walls 22 elastically restores in the approaching direction each other so that the spherical surface of the joint 12 is pressed against the contact tapered surface 52. In this moment, when the position of the joint 12 is displaced from the center of the hole 51 in the front and rear direction, the joint 12 fits in any one of the front end 51F, the central part 51C and the rear end 51R in the hole 51. In other words, since the hole 51 has an oval shape which is long in the front and rear direction, the joint 12 naturally fits in any section in the hole 51, if the positional displacement between the joint 12 and the hole 51 is within the length of the hole. Here, when the joint and the hole are to be forcibly fitted while correcting the positional displacement, the joint and the hole come in a state mutually pushing with a strong force, and might therefore cause deformation of the terminals. However, the present embodiment can avoid such situation even when the positions of the joint 12 and the hole 51 are displaced, since the hole 51 is long in the front and rear direction.

Additionally, in a state where the joint 12 is fitted with the front end 51F or the rear end 51R, the spherical surface of the joint 12 is held in contact with a front contact tapered surface 52F or a rear contact tapered surface 52R formed in a semi-circular arc part respectively, in the front or rear ends in the contact tapered surface 52 in the hole 51, whereas in a state where the joint 12 is fitted with the central part 51C, the spherical surface of the joint 12 is held in contact with a central contact tapered surface 52C formed in both the upper and lower edges of the central part 51C in the hole 51. This secures a good connection state between both the terminals 10 and 50, with the joint 12 fitted with any part in the hole 51.

When both the connectors M and F are in use, and when the male terminal 10 and the female terminal 50 are relatively displaced due to, for example, vibrations, the joint 12 displaces in the front and rear direction within the range from the front end 51F to the rear end 51R in the hole 51, while being in contact with the central contact tapered surface 52C in the hole 51. Here, when such relative displacement between the joint and the hole cannot be allowed, the joint and the hole edge of the hole strongly press each other along with the vibration, causing the stress to be concentrated onto the pressing part, and thereby deteriorating the durability. However, according to Embodiment 2, such stress concentration can be prevented owing to the relative displacement between the joint 12 and the hole 51 caused from vibration, and thereby enhancing the durability of the terminals.

As mentioned above, in the present embodiment, the pair of opposing walls 22 holds the joint 12 with the spherical surface of the joint 12 pressed against the contact tapered surface 52 in the hole 51, and thereby keeping a good connection state between the terminals 10 and 50.

Furthermore, the joint 12 is capable of displacing in the longitudinal direction of the hole 51 while being in contact with the central contact tapered surface 52C in the hole 51, and therefore, for example, when both the terminals 10 and 50 connected each other vibrated or the positions of the joint 12 and the hole 51 were relatively displaced, concentration of the stress applied onto the contacting part can be prevented owing to the relative displacement between the joint 12 and the hole 51. This enhances the durability of the terminals, and thereby keeping a good connection state between both the terminals 10 and 50 for a long period of time.

<Embodiment 3>

Figure 10:
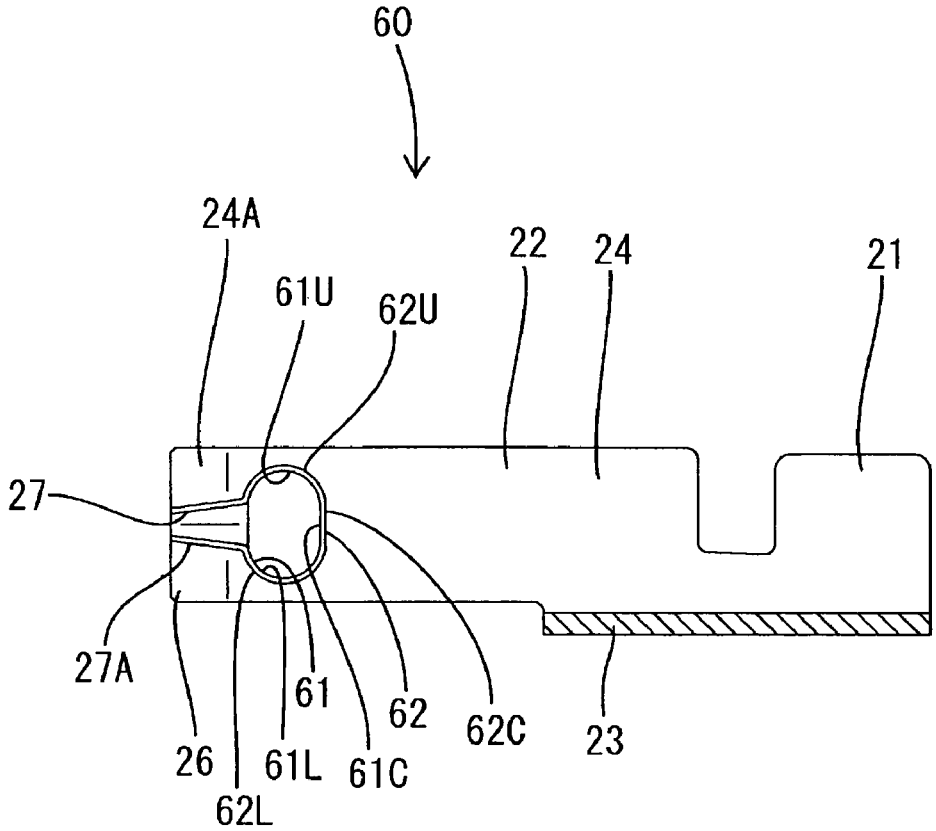
FIG. 10 is a side cross-sectional view of a female terminal according to Embodiment 3.

Next, in reference to FIG. 10, a terminal according to Embodiment 3 of the present invention is described. What is different from Embodiment 2 is that a terminal in the present embodiment is provided with a hole 61 formed in the opposing wall 22 in a female terminal 60, the hole 61 having an oval shape which is long in the vertical direction (the direction orthogonal to the insertion direction of the joint 12 into the pair of opposing walls 22). Additionally, the constituent elements same as those in Embodiment 1 and Embodiment 2 are allotted with the same numerals, so as to omit repetitive descriptions thereof.

The female terminal 60 comprises a pair of opposing walls 22 capable of holding the joint 12 in the male terminal 10 as in Embodiment 2, and formed in each opposing wall 22 is the hole 61 into which the joint 12 can be fitted. The holes 61 are arranged in positions mutually opposing in the opposing walls 22 and penetrate the opposing walls 22 in the wall thickness direction (the opposing direction of the opposing walls 22).

The hole 61 is in an oval shape which is long in the vertical direction, with the central part 61C having a constant length in its width in the front and rear direction (the width in the short side direction of the hole 61), while the upper end 61U and the lower end 61L having a semi-circular shape respectively. The front edge and the rear edge of the hole 61 (the front edge and the rear edge of the central part 61C) are nearly orthogonal to the upper edge and the lower edge of each of the opposing walls 22, in other words, the hole 61 is formed in a direction with its longitudinal direction orthogonal to the longitudinal direction of the opposing wall 22. Additionally, the central position in the vertical direction of the hole 61 coincides with the central position in the vertical direction of each opposing wall 22.

The width in the short side direction of the hole 61 is shorter than the diameter of the joint 12, in particular, the maximum diameter in the diameter of the cross section of the joint in parallel with the insertion direction of the male terminal 10 (the axis line direction of the connecting member 14).

And also, the hole edge in the side of the opposing face 24 in each hole 61 is, as in Embodiment 2, chamfered around the entire circumference, and forms a contact tapered surface 62, with the opening dimension of the hole 61 decreased as it goes to the back side of the hole 61 (the side opposite to the opposing face 24 side).

Connecting the terminals 10 and 50 according to Embodiment 3 (in short, fitting both the connectors M and F) causes the joint 12 to sink and fit in the hole 61 as in Embodiment 1, and the pair of opposing walls 22 elastically restores in the approaching direction each other so that the spherical surface of the joint 12 is pressed against the contact tapered surface 62. In this moment, when the position of the joint 12 is displaced in the vertical direction relative to the hole 51, the joint 12 fits in any one of the upper end 61U, the central part 61C, and the lower end 61L in the hole 61. In other words, since the hole 61 has an oval shape which is long in the vertical direction, the joint 12 naturally fits in the hole 61, if the positional displacement between the joint 12 and the hole 61 is within the length of the hole. Accordingly, as in Embodiment 2, such a situation that the joint and the hole come in a state mutually pressing with a strong force and furthermore cause deformation of the terminals can be avoided.

Additionally, in a state where the joint 12 is fitted with the upper end 61F or the lower end 61L, the spherical surface of the joint 12 is held in contact with an upper contact tapered surface 62U or a lower contact tapered surface 62L formed in a semi-circular arc part respectively in the upper or lower ends in the contact tapered surface 62 in the hole 61, whereas in a state where the joint 12 is fitted with the central part 61C, the spherical surface of the joint 12 is held in contact with a central contact tapered surface 62C formed in both the front and rear edges of the central part 61C in the hole 61. This secures a good connection state between both the terminals 10 and 60 as in Embodiment 2.

When both the connectors M and F are in use, and when the male terminal 10 and the female terminal 60 are relatively displaced due to, for example, vibrations, the joint 12 displaces in the vertical direction within the range from the upper end 61U to the lower end 61L in the hole 61, while being in contact with the central contact tapered surface 62C in the hole 61. Therefore, as in Embodiment 2, the stress is prevented from being concentrated onto a part owing to the relative displacement between the joint 12 and the hole 61 caused from the vibration, and thereby enhancing the durability of the terminals.

As mentioned above, in the present embodiment, the joint 12 is capable of displacing in the longitudinal direction of the hole 61 while being contact with the central contact tapered surface 62C in the hole 61, and therefore, as in Embodiment 2, the stress is prevented from being concentrated onto the contacting part between the joint 12 and the hole 61, thereby enhancing the durability of the terminals. This allows a good connection state between both the terminals 10 and 60 to be maintained for a long period of time.

<Embodiment 4>

Figure 11:
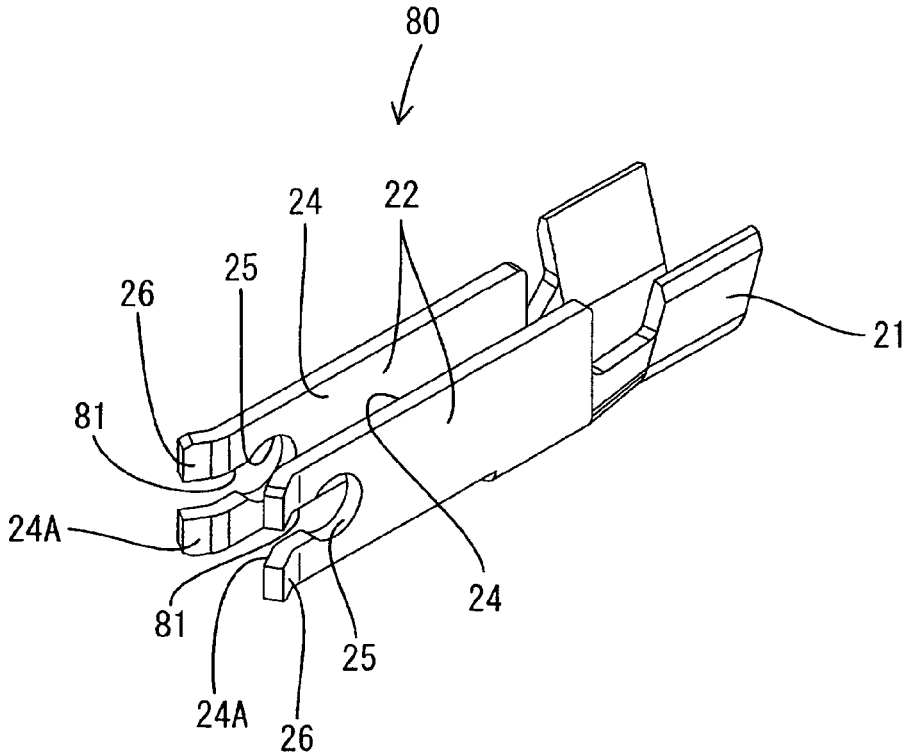
FIG. 11 is an external perspective view of a female terminal according to Embodiment 4.
Figure 12:
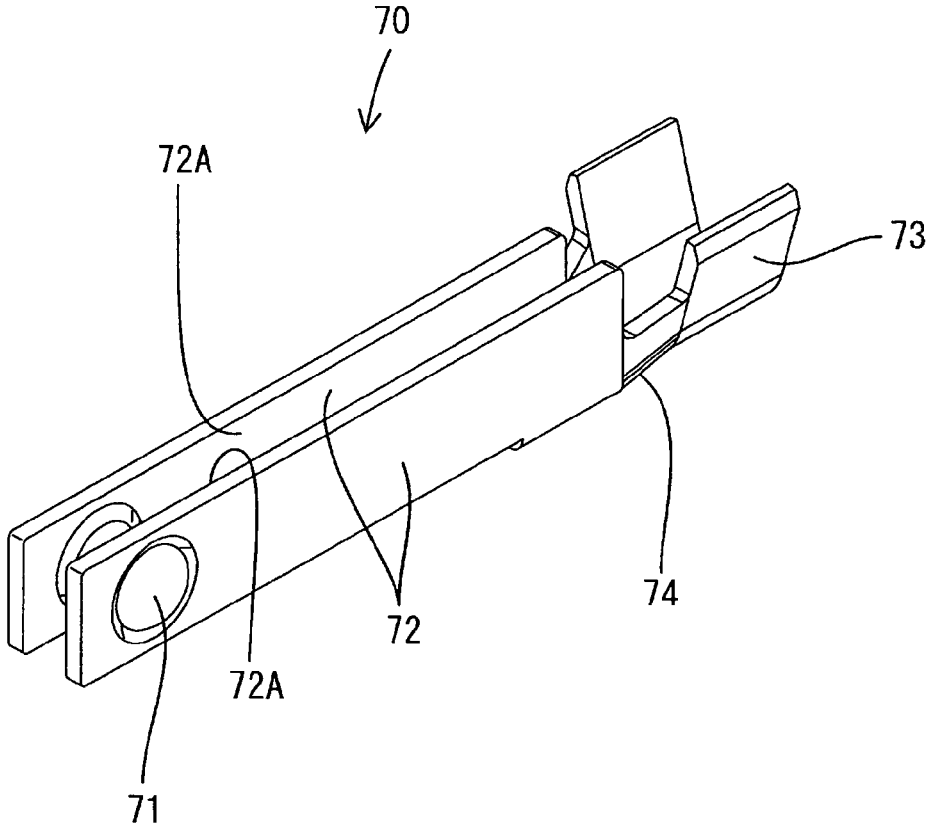
FIG. 12 is an external perspective view of a male terminal.
Figure 13:
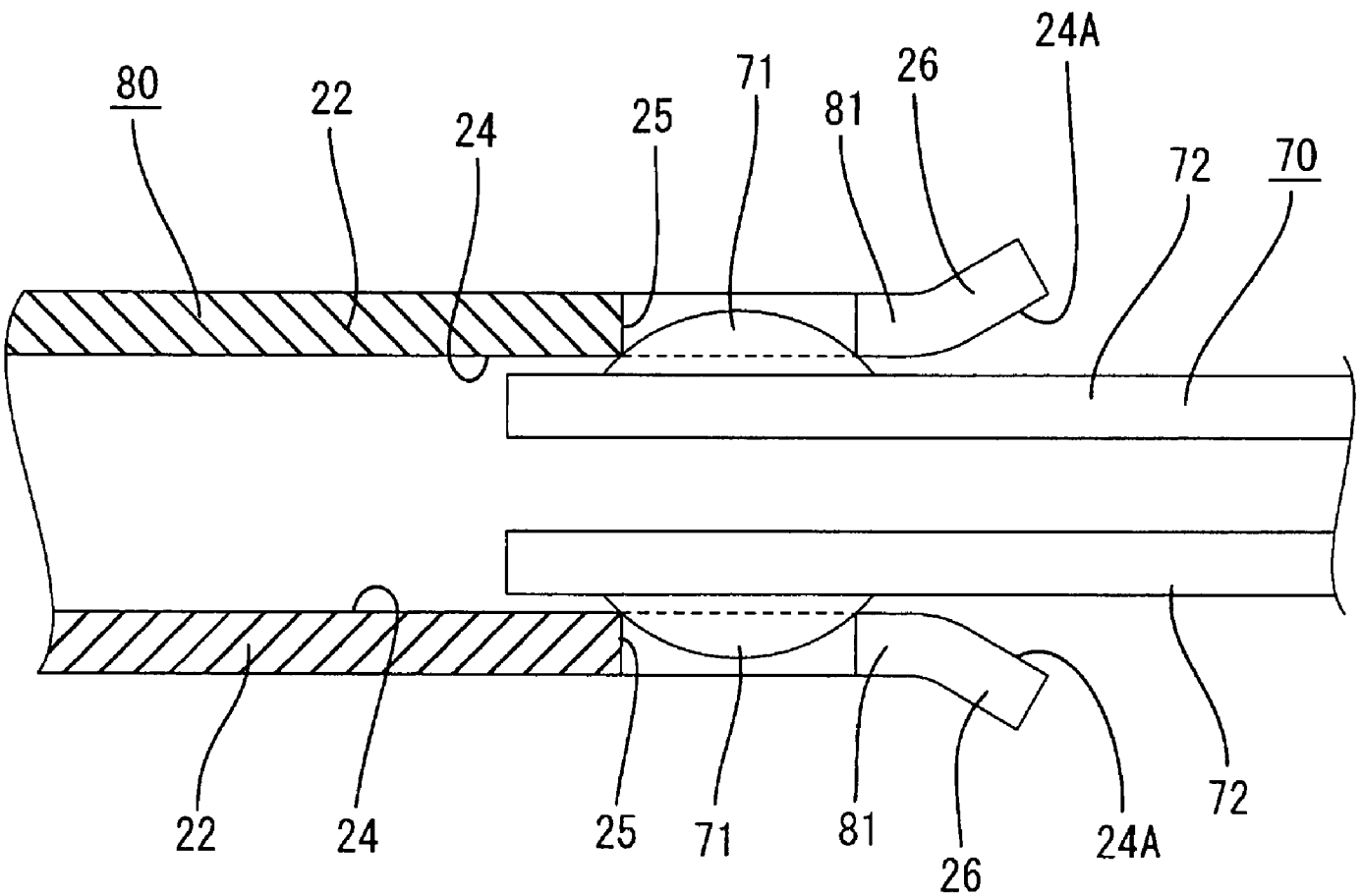
FIG. 13 is a partially-enlarged cross-sectional view showing a state where a joint is fitted in a hole.

Next, in reference to FIGS. 11 to 13, a terminal according to Embodiment 4 of the present invention is described. What is different from Embodiment 1 is that a terminal in the present embodiment is provided with a joint 71 in a male terminal 70 which is formed in a male side opposing wall 72 (corresponding to a plate member in the present invention) in a manner so as to protrude. Additionally, the constituent elements same as those in Embodiment 1 are allotted with the same numerals, so as to omit repetitive descriptions thereof.

A female terminal 80 according to the present embodiment, like the female terminal 80 in Embodiment 1, has a pair of female side opposing walls 22 and the barrel part 21 and is formed in a shape thin and long in the front and rear direction. Each female side opposing wall 22, like the female terminal 80 in Embodiment 1, is provided with a circular hole 25 into which the joint 71 in the male terminal 70 can be fitted, while the front end edge in the pair of female side opposing walls 22 is a guiding member 26 and the inner surface thereof is a guiding surface 24A.

Provided in the portion from the front end edge to the hole 25 on the female side opposing wall 22 is a guide groove 81 for guiding the joint 71. The guide groove 81 is formed in nearly the center in the short side direction of the female side opposing wall 22, extending in the longitudinal direction of the female side opposing wall 22. This guide groove 81 is formed by punching out each female side opposing wall 22 in the wall thickness direction, and the width thereof is constant in the longitudinal direction and smaller than the diameter of the hole 25. The guide groove 81 is in a slit shape, opening toward the front of each female side opposing wall 22.

The male terminal 70 according to the present embodiment is formed by bending a metallic thin plate having a high conductivity (for example, a copper alloy-made thin plate), and is in a shape thin and long in the front and rear direction on the whole like the female terminal 80. The rear end part of the male terminal 70 is a barrel part 73 to be caulked with the wire W in an electrically conductive manner. The barrel part 73 has nearly the same shape as the barrel part 21 in the female terminal 80.

Provided in the front of the barrel part 73 is a pair of male side opposing walls 72. Each male side opposing wall 72 is in a plate shape that is nearly rectangular, and thin and long in the front and rear direction on the whole like the female side opposing wall 22 in the female terminal 80, with its rear end connected with a bottom plate member 74 that extends from the bottom of the barrel part 73 to the front. The pair of male side opposing walls 72 is in a cantilevered shape on the whole, with its front end as a free end, and capable of elastic deformation mutually in the opposing direction (the expanding direction). The pair of male side opposing walls 72 is in a shape, with its rear end bent at the both side edges of the bottom plate member 74 in the nearly perpendicular direction to the plate face of the bottom plate member 74, and both the opposing faces (hereinafter, referred to as "male side opposing face 72A") are arranged nearly in parallel each other.

Each male side opposing wall 72 is provided with the joint 71. The joints 71 are arranged in the mutually opposing positions in the front end of the opposing walls 22 (the end part in the opposite side to the barrel part 73). The joint 71 has a shape formed by recessing the inner surface (the. male side opposing face 72A) of the male side opposing wall 72 by embossing, and protruding to the outside from the external surface of the male side opposing wall 72. Each joint 71 appears as if apart of a sphere is protruding from the external surface of the male side opposing wall 72, with its entire outer circumferential surface as a spherical surface. The maximum size of the joint 71 viewed from the outside of the male side opposing wall 72 (the side with which the hole 25 is fitted) is larger than the diameter of the hole 25.

The space between the pair of male side opposing walls 72 (the space between the male side opposing faces 72) is, in natural state with no elastic deformation of the male side opposing walls 72, the same as that between the female side opposing faces 24 in the female side opposing walls 22 in natural state.

Next, the connecting motion of the terminals 70 and 80 constituted as mentioned above is described. As in Embodiment 1, when the male connector M and the female connector F are faced each other in a fitting direction and brought closer to each other, the front end of the male side opposing wall 72 in the male terminal 70 is guided by the guiding surface 24A, so as to be smoothly put into a space between the female side opposing walls 22.

Then, the joint 71 in the male terminal 70 is fitted into the guide groove 81 in the guiding member 26 and inserted deeper than the guiding surface 24A along with further approach between the connectors M and F, so as to be in contact with the portion in the front side of the hole 25 in the female side opposing wall 22 and press the female side opposing wall 22 to the outside. This causes the pair of female side opposing walls 22 to be elastically deformed in an expanding direction, whereas the pair of male side opposing walls 72 to be elastically deformed in a closing direction, and thus the joint 71 advances deep to the hole 25 while being guided by the guide groove 81. In good time, the joint 71 sinks and fits in the hole 25, with the pair of female side opposing walls 22 elastically restored in a direction to mutually approach and with the pair of male side opposing walls 72 elastically restored in a direction to be apart from each other. Accordingly, as in Embodiment 1, the spherical surface of the joint 71 comes in a pressed-state against the hole edge of the hole 25 around the entire circumference, so that both the terminals 70 and 80 are in an electrically conductive and regular connection state.

In short, according to the present embodiment, even when the joint 71 rotates, its spherical surface is held constantly in contact with the-hole edge of the hole 25 round the entire circumference, so that, as in Embodiment 1, a good connection state between the terminals 70 and 80 can be effectively maintained even when the terminals 70 and 80 receive a force from any direction.

In addition, the joint 71 according to the present embodiment is formed in a manner so as to protrude in a male side opposing wall 72, and can therefore be formed by a press machine. Therefore, in comparison with the case for forming the joint by such as, for example, forging and cutting, the male terminal 70 can be manufactured easily.

In addition, the joint 71 is formed in a plate member like the male side opposing wall 72, so that the barrel part 73 can be easily provided in the male terminal 70 comprising the joint 71 having a spherical surface, and thus, the connection of the male terminal 70 to the wire W can be conducted by caulking the barrel part 73, like the female terminal 80.

Furthermore, the guide groove 81 is formed by punching out the male side opposing wall 72 in the wall thickness direction, and the hole 25 penetrates the male side opposing wall 72. Therefore, forming the guide groove 81 and the hole 25 can be done at the same time of punching out a metallic thin plate, thereby easily manufacturing the female terminal 80.

<Other Embodiments>

With embodiments of the present invention described above with reference to the accompanying drawings, it is to be understood that the invention is not limited to those precise embodiments, and the embodiments as below, for example, can be within the scope of the present invention.

(1) In the above embodiments, the holes 25 are provided in both sides of the pair of opposing walls 22, however, it maybe provided, for example, only in one side, and in such case, the spherical surface of the joint may not be necessarily provided in pair, and may be formed only in one side.

(2) In the above embodiments, the joint 12 is provided in the front end of the male terminal 10, however, the present invention is not limited to this, and the joint may be provided for example in an intermediate position in the front and rear direction.

(3) In the above embodiments, the joint 12 is inserted from the front side in the front and rear direction (the longitudinal direction) of the pair of opposing walls 22, however, the insertion direction of the joint may be in any direction, and may be, for example, in the short side direction or an oblique direction of the opposing wall.

(4) In the above embodiments, the guiding surfaces 24A are formed in both sides of the pair of opposing walls 22, however, it may be formed only in one side.

(5) In the above embodiments, the guide groove 27 for guiding the joint 12 is formed in the opposing wall 22, however, the guide groove may not be formed.

(6) In the above embodiments, the guide groove 27 is formed to gradually increase its width toward the hole 25, however, the present invention is not limited to this, and for example, the width of the guide groove may be constant or decrease as it goes toward the hole.

(7) In the above embodiments, a liquid metal is applied to the joint 12 and the contact tapered surface 25A, however, the liquid metal is not necessarily applied, and may be applied only to the joint or to the contact tapered surface.

(8) In the above embodiments, the guiding surface 24A is formed by bending the front end edge of the opposing wall 22, however the present invention is not limited to this, and the guiding surface may be formed by, for example, making the wall thickness of the front end edge of the opposing wall thinner as it goes to the front edge.

(9) In the above embodiments, the hole 25 is penetrating the opposing wall 22, however, the hole may be a dent, not penetrating the opposing wall.

(10) In the above embodiments, the hole edge of the hole 25 is chamfered so as to form the contact tapered surface 25A, however, may not be necessarily chamfered.

(11) In the above embodiments, the hole 25 is formed in the plate member 22 (the opposing wall), however the present invention is not limited to this, and the hole may be formed, for example, by being recessed in a block member. In such case, the joint may be formed in a plate member capable of elastic deformation in a fitting direction relative to the hole.

(12) In Embodiments 1 to 3, the joint 12 has a spherical shape, however, the joint may have any shape if it comprises a spherical surface capable of fitting with the hole in the opposing wall. For example, the joint 12 may be formed in a manner so as to be long in an opposing direction of the pair of opposing walls on the whole, with both ends in the longitudinal direction formed in hemisphere shapes (a shape with the spherical surface arranged in pair).

(13) In Embodiment 3, the hole 61 is formed with its longitudinal direction nearly orthogonal to the longitudinal direction of the opposing wall 22, however, the present invention is not limited to this, and the hole may be formed in a manner so that its longitudinal direction forms, for example, a acute angle or an obtuse angle relative to the longitudinal direction of the opposing wall.

(14) In Embodiment 4, the male side opposing wall 72 is arranged inside of the female side opposing wall 22 for connection, however, the present invention is not limited to this, and the female side opposing wall 22 may be arranged inside of the male side opposing wall 72. In this case, the joint may be formed in a manner so as to protrude inside of the male side opposing wall (in the side of the male side opposing face).

(15) In Embodiment 4, when connecting the terminals 70 and 80, both the male side opposing wall 72 and the female side opposing wall 22 are elastically deformed, however, the present invention is not limited to this, and any one of the male side opposing wall 72 and the female side opposing wall 22 may be constituted so as not to be elastically deformed, while the only other one may be elastically deformed.

The invention claimed is:

1. A pair of mutually connectable terminals, comprising:

one terminal provided with a joint having a spherical surface formed on the outer circumferential surface; and the other terminal provided with a hole into which the joint can be fitted;

wherein a plate member is formed at least one of the one terminal and the other terminal;

wherein at least one of the joint and the hole is formed in the plate member which can be displaced elastically in a fitting direction of the joint and the hole;

when connecting the pair of terminals, the joint touches the circumferential edge of the hole to displace the plate member elastically, and when the joint is fitted in the hole, the plate member is restored elastically and holds the spherical surface of the joint under such a state as the spherical surface is pressed against the edge of the hole;

wherein the hole is formed in the plate member, in which a guide groove for guiding the joint is formed from the front end edge in a connecting direction relative to the one terminal to the hole, and wherein the guide groove is formed to gradually increase its width toward the hole from the front end edge in the connecting direction.

2. The terminal according to claim 1 wherein the hole has a hole edge in a nearly circular shape capable of contacting with the spherical surface around the entire circumference.

3. The terminal according to claim 1 wherein the hole is in a nearly oval shape which is long in a connecting direction of the pair of terminals.

4. The terminal according to claim 1 wherein the hole is in a nearly oval shape which is long in a direction orthogonal to a connecting direction of the pair of terminals.

5. The terminal according to claim 1, wherein the hole is formed at least in one of a pair of the plate members capable of elastic deformation each other in an expanding direction, and the pair of plate members are characterized by being deformed elastically in an opening direction when the joint is inserted in a space there between, and restored elastically when the joint is fitted in the hole.

6. The terminal according to claim 5, wherein a guiding surface for guiding the joint is formed in the end edge in the insertion side of the joint in the plate member.

7. The terminal according to claim 5, wherein the hole is provided in both the pair of plate members in positions opposing each other, while the spherical surface of the joint is arranged in a pair.

8. The terminal according to claim 1, wherein the guide groove is formed by punching out the plate member in the plate thickness direction.

9. The terminal according to claim 1, wherein the hole is formed in the plate member in a manner so as to penetrate the same.

10. The terminal according to claim 1, wherein the joint is characterized by being spherical.

11. The terminal according to claim 1, wherein the joint is formed in the plate member in a manner so as to protrude.

12. The terminal according to claim 1, wherein a liquid metal is applied to at least any one of the spherical surface of the joint and the hole edge of the hole.

13. The terminal according to claim 1, wherein the hole edge of the hole is chamfered.

14. The terminal according to claim 1, wherein a wire fixing member is formed in the one terminal, the wire fixing member is fixed to a wire in an electrically conductive state.

15. The terminal according to claim 1, wherein a barrel part is formed in at least one of the one terminal and the other terminal, the barrel part is caulked with a wire in an electrically conductive manner.

16. The terminal according to claim 1, wherein the one terminal is housed in a male connector, and the other terminal is housed in a female connector.

* * * * *